United States Patent [19]

Thayer

[11] 4,399,646

[45] Aug. 23, 1983

[54] SAFETY STIRRUP

[76] Inventor: Lundie P. Thayer, Box 386, Fort Washakie, Wyo. 82514

[21] Appl. No.: 302,594

[22] Filed: Sep. 15, 1981

[51] Int. Cl.[3] ..... B68C 3/00

[52] U.S. Cl. ..... 54/49

[58] Field of Search ..... 54/47, 48, 49, 49.5

[56] References Cited

U.S. PATENT DOCUMENTS

| | | | |
|---|---|---|---|
| 410,939 | 9/1889 | Sollors | 54/49 |
| 729,361 | 5/1903 | Erickson | 402/38 |
| 744,653 | 11/1903 | Ward | 54/49 |
| 795,050 | 7/1905 | Markley | 54/49 |
| 1,124,801 | 1/1915 | Prater | 54/49 |
| 1,131,153 | 3/1915 | Moake | 54/49 |
| 1,162,324 | 11/1915 | Wassemiller | 54/49 |
| 1,276,819 | 8/1918 | Sklar | 54/49 |
| 1,314,992 | 9/1919 | Wallis | 54/49 |
| 1,323,549 | 12/1919 | Porter | 54/49 |
| 1,421,304 | 6/1922 | Prater | 54/49 |
| 1,520,586 | 12/1924 | McCamis | 54/49 |
| 1,622,510 | 3/1927 | Hendriks | 54/49 |
| 4,209,962 | 7/1980 | Forest | 54/49 |

FOREIGN PATENT DOCUMENTS

| | | | |
|---|---|---|---|
| 4863 | of 1876 | United Kingdom | 54/49 |

*Primary Examiner*—Gene Mancene
*Assistant Examiner*—David Tarnoff
*Attorney, Agent, or Firm*—Berman, Aisenberg & Platt

[57] ABSTRACT

A safety stirrup has a forward guard and safety release which is pivotally mounted to a U-shaped member. The U-shaped member is reinforced by a sole plate and hangs from the saddle by a ring placed such that the stirrup naturally extends outwardly from the horse. The stirrup is very safe since both of the rider's hands are free during mounting to control the horse, the sole plate protects the rider's foot, and the safety release prevents the rider's foot from being hung-up in the stirrup.

6 Claims, 4 Drawing Figures

FIG.1
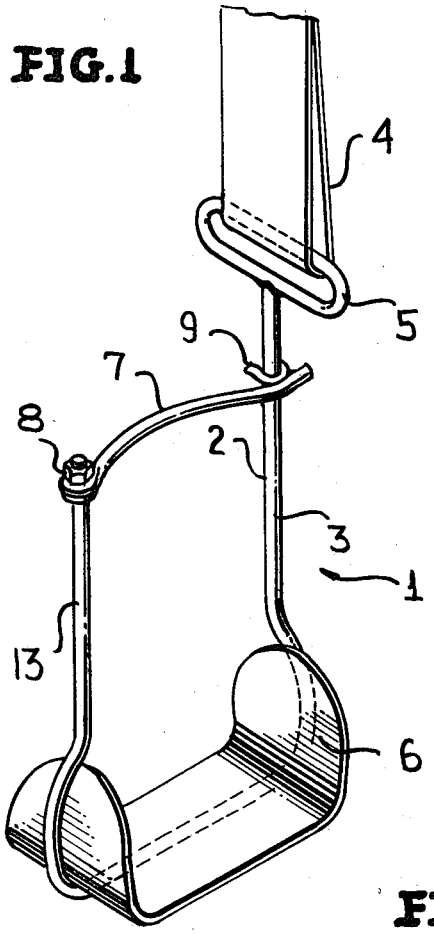
FIG.2
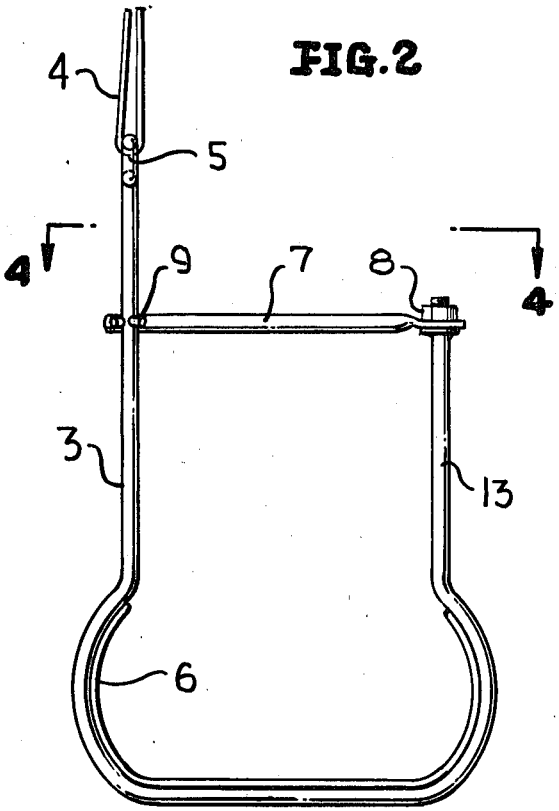
FIG.3
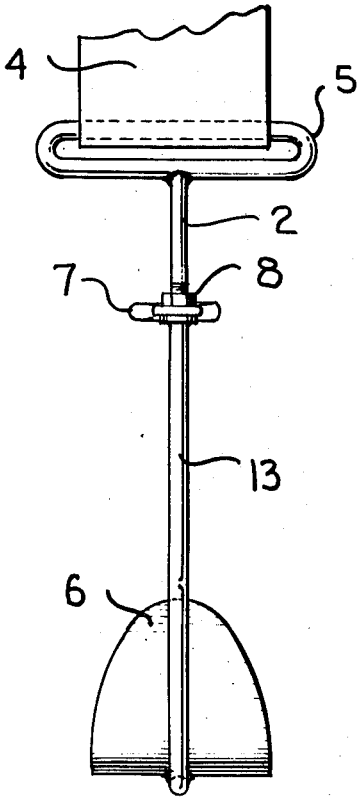
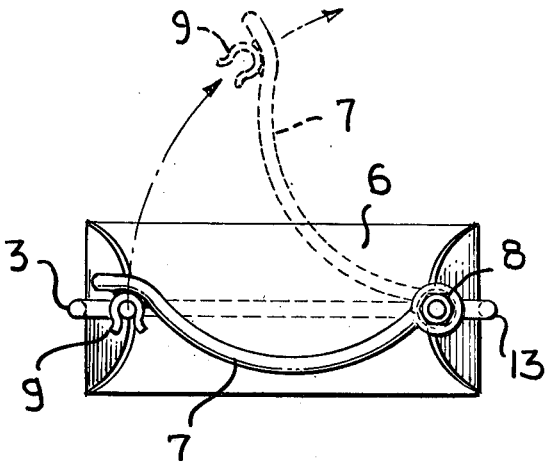
FIG.4

SAFETY STIRRUP

TECHNICAL FIELD

This invention is a stirrup for a saddle. The stirrup has several safety features.

BACKGROUND ART

Safety stirrups are known in the art. The prior art safety stirrups are complicated, requiring complex mechanisms to operate. In the stirrups shown in U.S. Pat. Nos. 1,276,819, Sklar; 1,314,992, Wallis; 1,323,549, Porter; 1,520,586, McCamis; 1,622,510, Hendriks; and 4,209,962, Forrest, the stirrup is constructed of at least two parts which pivot with respect to each other and are held together by a hook or a clip. The foot of a rider fits in the stirrup such that when the rider falls, the rider's foot engages a wire or other safety mechanism which releases a latch to permit the various parts of the stirrup to separate from each other, thus releasing the foot from the stirrup. In these stirrups, the rider's foot is released from the bottom of the stirrup.

STATEMENT OF THE INVENTION

In the safety stirrup according to the invention, there is no spring-loaded mechanism and the safety release feature is extremely non-complex. The stirrup includes a generally U-shaped member with a safety release traversing the top of the U-shaped member. The safety release acts also as a forward guard to prevent a rider's foot from sliding out of the stirrup in a forward direction. The forward guard is pivoted on one side of the stirrup and is releasably attached to the other side of the stirrup. When a rider's foot falls out of the stirrup, the forward guard swings backward so as to release the foot from the stirrup. Another safety feature of the present invention is a heavy sole plate along the bottom of the stirrup. The sole plate is strong and broad enough so that if a rider's foot is caught under a horse which has fallen, the foot will be protected from crushing by the horse due to the thickness and width of the safety sole plate. A third safety feature is that the plane of the saddle ring is orthogonal to the plane of the U-shaped stirrup. The saddle ring thus allows the stirrup to hang perpendicular to the horse, permitting the rider to put his foot in the stirrup without having to use one hand to hold the stirrup out for his foot as in the ordinary stirrup arrangement. Both of the rider's hands may be used to grasp the reins and the saddle, providing for more safety.

BRIEF DESCRIPTION OF THE FIGURES

FIG. 1 is a perspective view of the safety stirrup of the invention.

FIG. 2 is a front elevation of the safety stirrup.

FIG. 3 is a side elevation of the safety stirrup.

FIG. 4 is a plan view of the safety stirrup.

DETAILED DESCRIPTION OF THE INVENTION

In FIG. 1, the safety stirrup of the invention is generally indicated as 1. The stirrup comprises a generally U-shaped member 2 having post portions 3 and 13. The stirrup is attached to the saddle leather 4 by means of a saddle ring 5. The saddle ring is attached to one of the posts and is oriented with its plane generally orthogonal to the plane of the U-shaped member 2. This orientation allows the stirrup to extend outwardly from the horse, providing the safety feature that the rider's hands need not be used to hold the stirrup out for his foot. The bottom of the U-shaped member has attached thereto a sole plate 6. The sole plate may be, for example, welded to the U-shaped member. The sole plate is broad enough to provide support for the foot of the rider and also is strong enough to provide an additional safety feature of protecting the foot of the rider from being crushed should the rider's foot be caught beneath a horse which has fallen.

The safety stirrup of the invention also includes a safety release and forward guard 7 located at the top of the generally U-shaped member 2. The safety release is attached to post 13 by a nut and washer 8 which allow the safety release to pivot about the post 13. At the other post 3, the safety release 7 has a spring clip keeper 9 which releasably secures the safety release to post 3. The safety release and forward guard 7 performs two functions. First, it prevents the rider's foot from sliding too far forward in the stirrup. However, should the rider be thrown from the horse, the top of the rider's foot will push against the safety release 7 and the spring clip 9 will release the post 3 allowing the safety release to pivot around the post 13, thus releasing the rider's foot from the stirrup.

It may be seen that the safety stirrup of the invention combines three very important safety features to produce a greatly improved stirrup. The rider using the safety stirrup of the invention can mount the horse safely, and can ride with his or her foot fully into the stirrup without fear of having a foot hung-up should the rider be thrown from the horse or crushed should the horse fall on the foot. In contrast with the prior art, the safety stirrup of the invention always has a fixed bottom to give the feel of security to the rider since the foot is released from the stirrup in the same direction as when it is normally withdrawn when dismounting from the horse. When the foot is released from the inventive safety stirrup, no parts of the stirrup are left dangling below the stirrup as in the prior art.

While the preferred embodiment has the forward guard, it should be noted that an experienced rider who does not need protection from inserting the foot too far into the stirrup, may elect to dispense with the safety release and forward guard altogether.

What is claimed is:

1. A safety stirrup comprising:

a generally U-shaped member having two posts which extend along adjacent axes and a lower portion connecting lower ends of said posts for receiving a rider's foot, a safety release and forward guard comprising a horizontal member spaced from said lower portion and having one end pivotally attached to a first of said posts for rotation about said axis of said first post, and the other end releasably attached to the second of said posts, one of said post extending upwardly beyond said safety release and forward guard and being attachable to a saddle strap, whereby said safety release and forward guard acts to prevent a foot of a rider from going too far into the stirrup and also releases the rider's foot from the stirrup when pivoted about said first post.

2. The stirrup of claim 1 including a rigid plate fixed to said lower portion of said U-shaped member which extends between said two posts.

3. The safety stirrup of claim 2 wherein said rigid plate has a surface with a portion which conforms to the shape of a lower part of said U-shaped member, and where said part of said U-shaped member is attached to said portion.

4. The safety stirrup of claim 1 wherein said safety release and forward guard is arcuate in a plane transverse to a plane containing said axes.

5. The safety stirrup of claim 1 further comprising:

a spring clip for releasably attaching said other end of said safety release and forward guard to said second post.

6. The safety stirrup of any preceeding claim further including a saddle ring, comprising a means fixed to one of said posts for receiving leather straps from a saddle, where said ring is generally orthogonal to said U-shaped member.

* * * * *